United States Patent [19]

Kawakatsu et al.

[11] 4,324,856

[45] Apr. 13, 1982

[54] SILVER HALIDE PHOTOGRAPHIC MATERIAL

[75] Inventors: Satoshi Kawakatsu; Shigeto Hirabayashi; Hidetaka Ninomiya; Yutaka Kaneko, all of Hino, Japan

[73] Assignee: Konishiroku Photo Industry Co., Ltd., Japan

[21] Appl. No.: 194,799

[22] Filed: Oct. 7, 1980

[30] Foreign Application Priority Data

Oct. 11, 1979 [JP] Japan ..... 54-131376

[51] Int. Cl.[3] ..... G03C 1/34; G03C 1/06

[52] U.S. Cl. ..... 430/566; 430/402; 430/565; 430/600; 430/601; 430/610; 430/955; 430/957; 430/959; 430/960

[58] Field of Search ..... 430/955, 956, 957, 958, 430/959, 960, 601, 600, 610, 529, 510, 566, 505

[56] References Cited

U.S. PATENT DOCUMENTS

| | | | |
|---|---|---|---|
| 3,210,192 | 10/1965 | Willems et al. | 430/601 |
| 3,443,951 | 5/1969 | Willems et al. | 430/610 |
| 3,984,245 | 10/1976 | Hirose et al. | 430/957 |

*Primary Examiner*—Mary F. Downey
*Attorney, Agent, or Firm*—Bierman & Bierman

[57] ABSTRACT

A photographic silver halide material is disclosed which contains a precursor of photographic chemicals.

5 Claims, No Drawings

SILVER HALIDE PHOTOGRAPHIC MATERIAL

This invention relates to the precursor of the photographic chemicals and more particularly to silver halide photographic material containing the precursor of photographic additives or of photographic processing agent.

Photographic chemicals are generally put in use by being added to the photosensitive material or being contained in the photographic processing liquid, according to its purposes.

Recently, for the purpose of simplification of processing steps and speeding up of processing, an attempt to add and combine specific photographic processing agent, for example, developing agent in the photosensitive material has frequently been observed.

The way to add photographic processing agent in the photosensitive material in this way has an advantage to simplify processing due to the reduction of ingredient to be contained in the processing liquid and further it is a greatly effective method to add such ingredients in advance to the photosensitive material as a means to enable an ingredient that is impossible to be stored as a developing liquid ingredient due to its instability against alkalinity, or an ingredient that is impossible to be used due to its reactivity with other chemicals in the developing liquid, or an ingredient that is hard to dissolve in the developing liquid with a necessary concentration, for example.

However, in order for each chemical added to the photosensitive material to display its effect timely, it is necessary to study in advance in which layer of photosensitive material structural layers the chemical should be added and furthermore, in this case, it is desirable that each reagent added is non-diffusable in the layer and is chemically stable.

This invention relates, among above-mentioned subjects, to stabilization of chemicals to be added to the photosensitive material structural layers in particular and more particularly to the precursor of the specified photographic chemicals.

Among chemicals used for photographic application, the nitrogen-containing organic base and compound containing quaternary nitrogen atom, in particular, is one of important photographic chemicals due to the fact that great many compounds thereof are being practically used. For example, paraaminophenol compounds are practically used as black and white developing agent, primary aromatic amine compunds as color developing agent, nitrogen-containing hetero ring compounds, especially azole compounds are as photographic stabilizer, fog restrainer or image toner, hydroxylamine compound as preservative and hydrazine compounds as fogging agent of direct positive photosensitive material and further, N,N,N',N'-tetraalkyl-P-phenylenediamine and alkylamine compounds are known as a development accelerator.

However, many of the nitrogen-containing organic base and the compounds containing quaternary nitrogen atom have such weak point that they can not be used easily since they have various kinds of problems such as—they are chemically active and are easily oxidized in the air and in some cases they easily react with silver halide resulting in desensitization and making stain or they diffuse to another layer because the sizes of their molecule are not so big and therefore diffusion resistance is not given thereto. Consequently, the compound having an excellent practical performance has so far been selected or the research on the improved adding method has been tried. As a result thereof, regarding the nitrogen-containing organic base, several examples of the method to put it in the photosensitive material stably have been known. For example, regarding the method to put the primary aromatic amine developing agent in the photosensitive layer, the method to use Schiff salt with salicylaldehyde as a precursor of the developing agent (U.S. Pat. No. 3,342,599), the method to use jointly with metallic salt of lead or cadmium (U.S. Pat. No. 3,719,492), the method to use a precursor that is made a type of phthalimide by the reaction with phthalic acid (British Pat. No. 1,069,061), the method (Japanese Patent L-O-P Publication No. 111729/1978) to use jointly with ring $\beta$-dicarbonyl compound and the method (Japanese Patent L-O-P Publication No. 135628/1978) to use a precursor combined with substituted or non-substituted 2-(benzene sulfonyl)-ethoxycarbonyl are known and besides these, the related technologies are described even in West German Pat. Nos. 1,159,758, 1,200,679 and U.S. Pat. No. 3,705,035.

Meanwhile, regarding the compound containing a quaternary nitrogen atom as well, an attempt to put it in the photosensitive material, for example tetrazolium salt of fog restrainer and a quaternary nitrogen-containing salt that is a fogging agent for direct positive are described in the U.S. Pat. Nos. 3,071,465 and 3,719,494 respectively.

However, with only the known technologies mentioned above, it is not possible to obtain enough color density on development and it is not possible to adequately prevent the occurrence of desensitization, fog or stain etc. when preserving the photosensitive material.

Now, the first object of this invention is to offer the use of a precursor for making photographic chemicals being contained in the photosensitive material stably and the second object is to offer the silver halide photographic material containing a precursor that is remarkably improved on occurrence of densensitization, fog, reduction of maximum density or stain, during preservation.

Furthermore, the third object of this invention is to offer silver halide photographic material in which nitrogen-containing organic base, especially primary aromatic amine developing agent is contained as a precursor and which is stable and suitable for rapid processing.

In this invention the compounds with the following formula is proposed:

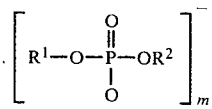

$$[D]^{+m} \cdot \left[ R^1-O-\overset{\overset{\displaystyle O}{\|}}{\underset{\underset{\displaystyle O}{|}}{P}}-OR^2 \right]^{-}_{m}$$

wherein D represents a nitrogen-containing organic base or a compound containing quaternary nitrogen atom and $R^1$ and $R^2$ represent respectively a hydrogen atom (excluding the case where both are a hydrogen atom), a substituted or non-substituted alkyl, alkenyl, cycloalkyl, phenyl or hetero cyclic group, or they may combine with each other to form a ring. Further, $R^1$ and $R^2$ may form pyrophosphoric ester or polyphosphoric ester by having the repeated structure respectively. An integer from 1 to 5 is represented by m.

The compound of the formula is obtained by reacting a phosphoric ester with a nitrogen containing organic base or a compound containing a quaternary organic base. One example of phosphoric ester used in this invention will be shown as follows:
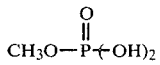
P-1
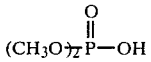
P-2
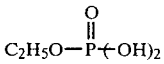
P-3
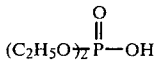
P-4
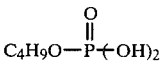
P-5
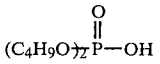
P-6
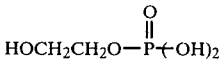
P-7
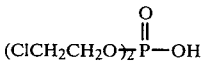
P-8
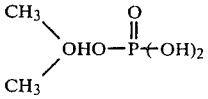
P-9
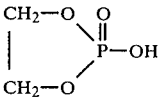
P-10
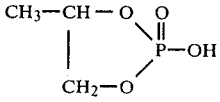
P-11
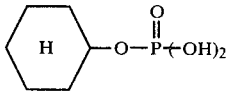
P-12
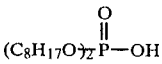
P-13
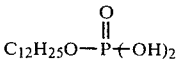
P-14
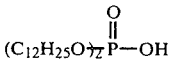
P-15
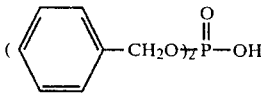
P-16
4
-continued
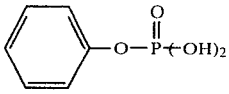
P-17
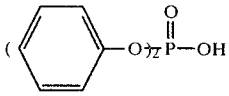
P-18
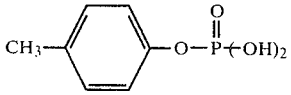
P-19
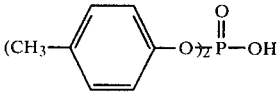
P-20
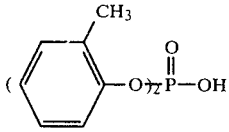
P-21
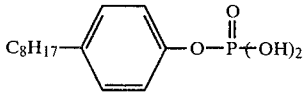
P-22
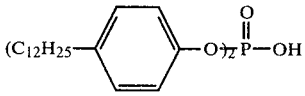
P-23
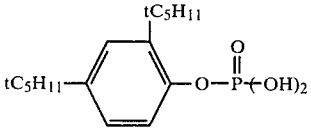
P-24
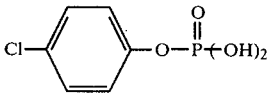
P-25
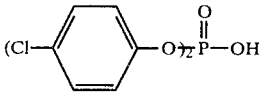
P-26
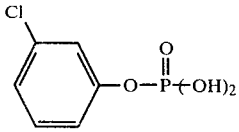
P-27
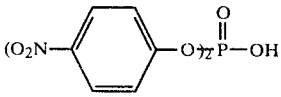
P-28
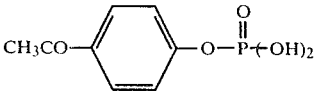
P-29

-continued

P-30

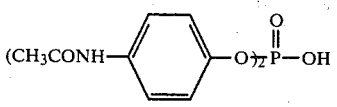

P-31

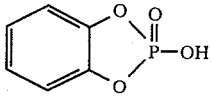

P-32

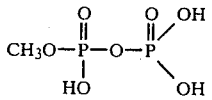

P-33

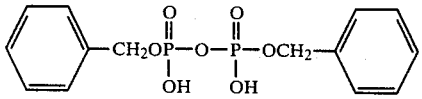

P-34

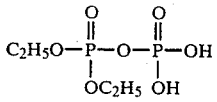

P-35

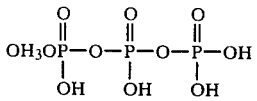

P-36

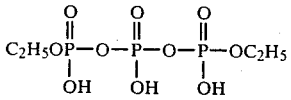

P-37

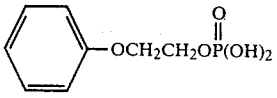

P-38

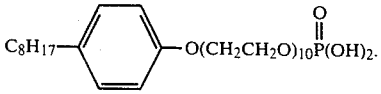

Aryl substituted phosphoric ester is preferable as phosphoric ester, and in the above di-substituted phosphoric ester is further preferable to mono-substituted one. Among the aryl group, a chlorophenyl or methyl phenyl group is more preferable.

Next, nitrogen-containing organic base used in this invention is an organic compound containing nitrogen atom that can produce a salt with an inorganic acid and showing basicity, and the especially important example thereof is amine. And primary amine ($R\text{-}NH_2$), secondary amine ($R\text{-}NH\text{-}R_3$) and tertially amine

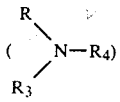

etc. are available as amine of chain form, while pyridine, quinoline, piperidine and imidazole etc. are available as an amine compound of ring form and they are famous as an example of typical hetero ring organic base. Compounds such as hydroxylamine, hydrazine and amidine etc., moreover, are also useful as amine of chain form. Meanwhile, as a compound containing a quaternary nitrogen used in this invention, salt or hydroxide of quadrivalent nitrogen compound having covalent bond, that is, a nitrogen compound shown with a structural formula of $RR_3R_4R_5\ N^+-X^-$ ($X^-$ represents inorganic and organic anion radical or $OH^-$ ion) is known. R, $R_3$, $R_4$ and $R_5$ individually represent a hydroxyl, alkyl, alkenyl, cycloalkyl, aryl, acyl, amino, carbamoyl, sulfonyl, or 5 or 6 membered and a nitrogen, oxygen or sulfur atom containing heterocyclic group. Two of $R_1$, $R_2$, $R_3$ and $R_4$ may form a nitrogen containing an 5 or 6 membered heterocycle by bonding each other.

Compounds containing nitrogen-containing organic base and quaternary nitrogen atom which are usable in this invention, are shown as follows:

| Number | Chemical formula | Activity |
|---|---|---|
| N-1 | 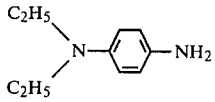 | Color development |
| N-2 | 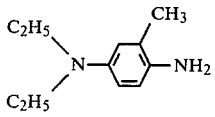 | Color development |
| N-3 | 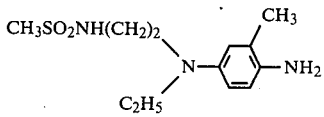 | Color development |
| N-4 | 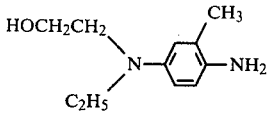 | Color development |
| N-5 | 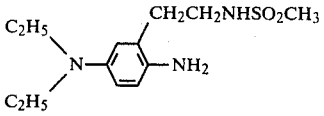 | Color development |
| N-6 | 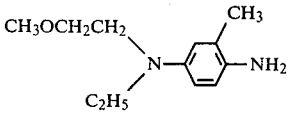 | Color development |
| N-7 | 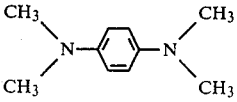 | Development acceleration |
| N-8 | 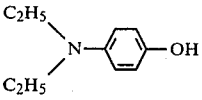 | Development acceleration |
| N-9 | 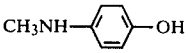 | Black and white development |
| N-10 | 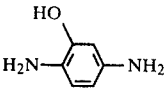 | Black and white development |
| N-11 | 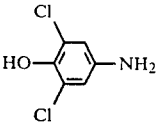 | Color development |
| N-12 | 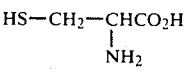 | Sensitization |
| N-13 | 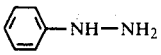 | Fog |

-continued

| Number | Chemical formula | Activity |
|---|---|---|
| N-14 | 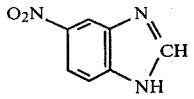 | Development inhibit |
| N-15 | 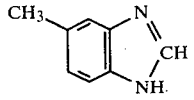 | Development inhibit |
| N-16 | 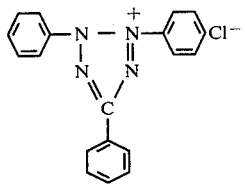 | Development inhibit |
| N-17 | 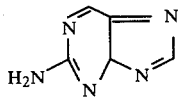 | Development inhibit |
| N-18 | 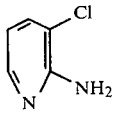 | Image toning |

-continued

| Number | Chemical formula | Activity |
|---|---|---|
| N-19 | 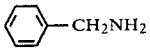 | Development acceleration |
| N-20 | $NH_2OH$ | Preservation |
| N-21 | 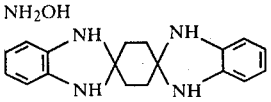 | Fogging |
| N-22 | 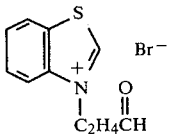 | Fogging |
| N-23 | 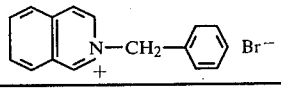 | Fog acceleration |

Concrete examples of compounds obtained from the reaction between a nitrogen-containing organic base or a compound containing quaternary nitrogen atom of this invention and phosphoric ester, are shown as follows:

C-1

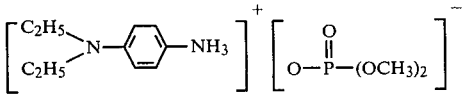

C-2

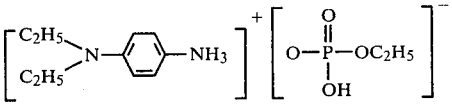

C-3

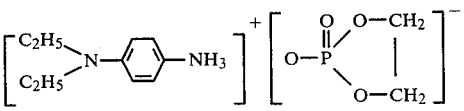

C-4

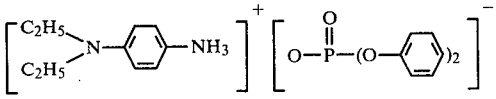

C-5

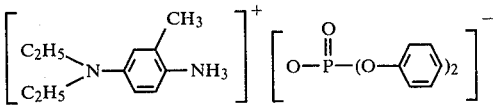

C-6

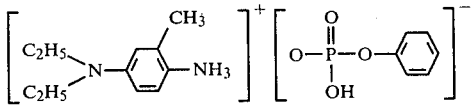

C-7

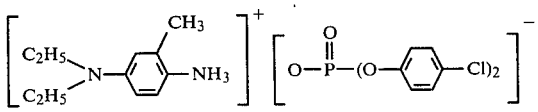

C-8

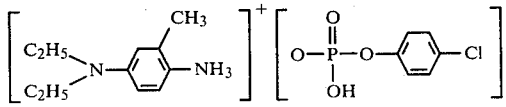

C-9

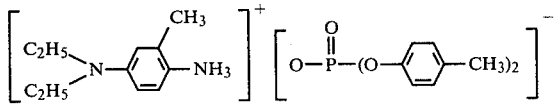

C-10

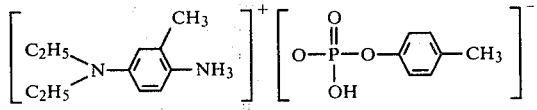

C-11

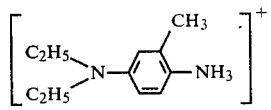

C-12

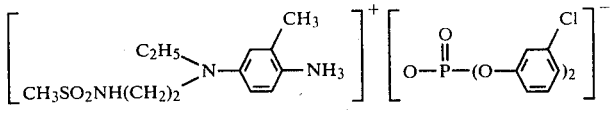

C-13

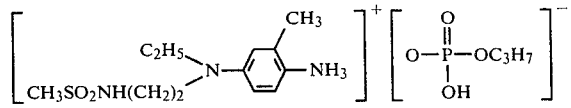

C-14

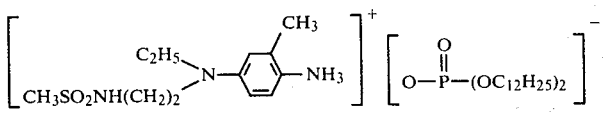

-continued

C-15

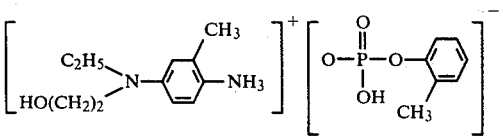

C-16

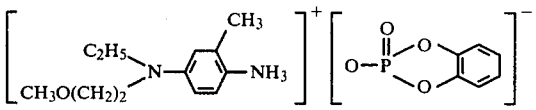

C-17

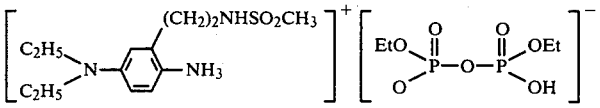

C-18

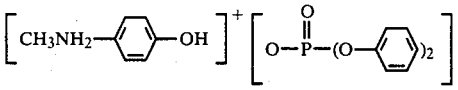

C-19

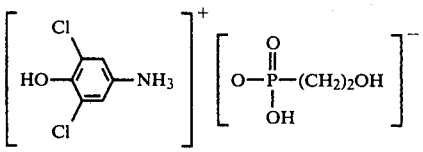

C-20

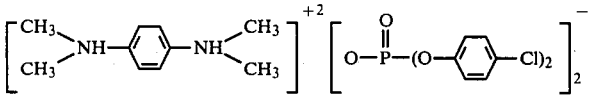

C-21

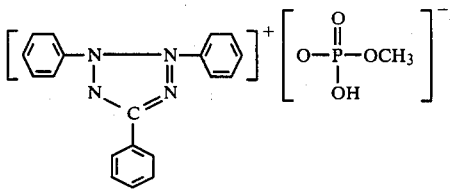

C-22

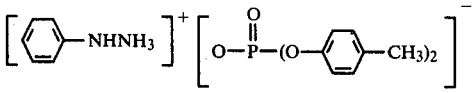

C-23

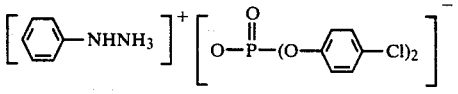

C-24

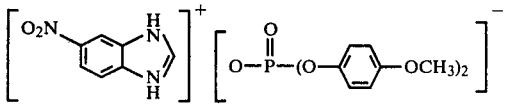

C-25

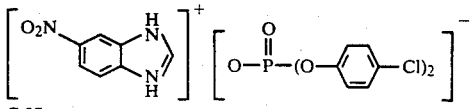

C-26

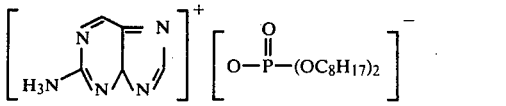

C-27

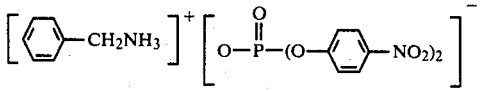

C-28

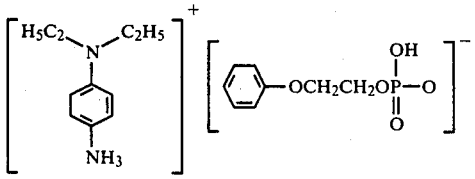

C-29

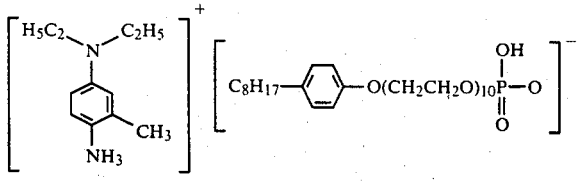

Above-mentioned compounds are obtained by the reaction between phosphoric ester and free organic base and also they are obtained by the reaction between salt such as sodium or potassium of phosphoric ester and inorganic salt of organic base or salt of quaternary nitrogen compound in a simple way. This method may be done even in the gelatin solution.

Typical preparative methods for the compounds used in this invention are shown as follows:

Preparation example 1 (Exemplified compound No. 5)

Diphenyl phosphoric acid 5 g and 3.6 g of 4-amino-3-methyl-N,N diethylaniline were dissolved in acetone respectively and both solutions were mixed at the temperature below 5° C. By adding ether to such solution, a crystal was separated out. By washing the crystal with ether, 5.2 g of colorless solid with mp. 86°-88° C. was obtained.

Preparation example 2 (Exemplified compound No. 8)

Some 4.16 g of mono-p-chlorophenyl phosphoric acid and 3.6 g of 4-amino-3-methyl-N,N-diethylaniline were dissolved in methanol respectively and both solutions were mixed at the temperature below 5° C. By adding ether to such solution, a crystal was separated out. By washing the crystal with ether, colorless solid with mp. 108°-110° C. was obtained.

Melting points of the compounds obtained by the methods of preparation examples 1 and 2 are shown as follows.

| Number of exemplified compound | Melting point (°C.) |
|---|---|
| 6 | Caramel |
| 7 | 119-121 |
| 9 | 119-120.5 |
| 10 | Caramel |
| 11 | 86-87 |
| 14 | 111-112 |

Preparation example 3 (Exemplified compound No. 22)

Some 1.45 g of phenylhydrazine hydrochloride was dissolved in $H_2O$ and to the solution thus obtained, a water solution of 3.00 g of di-p-methylphenyl sodium phosphate was added at the temperature below 5° C. A crystal separated out was collected and washed with $H_2O$ and colorless solid with mp. 146°-147° C. was obtained.

Examples of compounds obtained by the method of preparation example 3 are shown as follows.

| Number of exemplified compound | Melting point (°C.) |
|---|---|
| 23 | 158-159 |
| 24 | 123-125 |
| 25 | 72-75 |

Other compounds can also be prepared in the same way.

The structure of the compounds mentioned above was supported by nuclear magnetic resonance spectrum.

When these compounds are prepared in hydrophile colloid solution, they can be used as they are since said compounds are dispersed in the hydrophilic colloid solution and are kept in that situation but when these compounds are in the state that they are isolated, they are dissolved in hydrophilic organic solvent such as methyl alcohol, ethyl alcohol or acetone and are added to hydrophilic colloid solution and dispersed. And as other dispersion methods, a method to use latex or other polymer or a method to disperse said compound in hydrophilic colloid solution using coupler solvent such as tri-o-cresylphosphate and dibutyl phthalate which are used in the oil-protect type photosensitive material, are given. And in order to disperse these oil phases in water phases, the use of generally known surface active agent of anion, nonion, cation or amphoteric is recommended. As hydrophilic colloid, gelatin, gelatin derivative known as photographic binder, graft polymer of gelatin, various kinds of cellulose, polyvinyl alcohol partially saponified material, sodium alginate and poly-N-vinyl pyrrolidon can widely be used. It is also possible to add known photographic anti-oxidant or stabilizer to such emulsified matter.

Regarding the amount of precursor compound of this invention contained in the photosensitive material, 0.1-10 mol per 1 mol of silver halide is preferable and 0.25-5 mol is more preferable for primary aromatic amine developing agent precursor and for precursor compound having other action and function, 0.0001-1.0 mol is preferable and 0.0005-0.5 mol is more preferable.

The precursor compounds contained in the photosensitive material with this invention are chemically stable and their reaction with silver halide and other additives in the photosensitive material is inactive and therefore they are useful for the improvement of storability and photographic characteristic, especially desensitization and formation of fog or stain of the photosensitive material.

Furthermore, when precursor of developing agent such as paraphenylene diamine or paraaminophenol which is a nitrogen-containing organic base is contained in the photosensitive material with this invention, it is possible to develop with processing liquid with simple composition containing mainly alkali reagent called alkali activator, which is a very effective method from the view point of simplification of processing and prevention of environmental pollution. As an example, by making direct positive type silver halide color photographic material contain therein primary aromatic amine color developing agent and hydrazine compound that is fogging agent according to the method of this invention, it is possible to form a direct reversal color image with alkali activator processing alone.

Activator liquid is basically the one formed by eliminating the developing agent from the color developing liquid used generally and the pH thereof is in the range of 7-14 and the range of 8-13 is especially preferable. And the temperature for processing with activator liquid is 20° C.-70° C. and the most preferable temperature is 30° C.-60° C. As a buffer for activator liquid, sodium hydroxide, sodium carbonate and other known compounds can be used independently or in combination.

And, for convenience of chemical preparation, it is also possible to add into activating solution with other additives, such as antifogging agent, development accelerator, water softening agent, or organic solvent.

In addition, as for the photographic processes of the invention, a variety of other known processes including bath processing, a spraying processing that the processing solution is made into a mist, a web processing that a photographic material is attached to a carrier being impregnated with processing solution, or a processing using viscous processing solution, a variety of which may be used.

When such photographic material of the invention is the one for color photography, the non diffusible couplers which are contained therein is the one known, including the couplers for forming black dyes as described in the West German OLS No. 2,644,915. Besides the above, development inhibitor-releasing couplers and development inhibitor-releasing compounds may be added therein. As for the solvents to solve said couplers, various known solvents for coupler are desirable to be used.

Silver halide to be used in a photographic material of the invention is prepared by the conventional processings, and the composition thereof may be one of those of silver chloride, silver bromide, silver bromochloride, silver iodobromide and silver chloroiodobromide. Those silver halide emulsions can be chemically sensitized by means of conventional processing.

In addition, said emulsion may contain additives which are being usually used, such as photosensitive dye, antifogging agent, hardening agent, plasticizing agent, surface active agent.

As for a support for the layers to be used in the photographic materials of the invention, cellulose film, plastic film and the like, and besides, glass plate and paper sheet, and further, laminated matter or paper sheet laminated with polymer, etc., any of which is useful as the support.

As described above, the photographic material of the invention may also be such a material comprising a support, at least one or more color dye image forming layers containing non-diffusible couplers which are coated on said support and other auxiliary layers, etc., and a material containing precursor of color developing agent in at least one layer of either composed layers is included in said materials.

And, the characteristics of photographic materials of the invention are advantageous in many respects that not only color density thereof is high, but fog density is low, and that no residual color is caused in a photographic material after processed because said precursor is colorless after processed by an activator, and further that the ageing stability of unprocessed photographic material is superior, and so on.

The following are the description of the invention referring to the examples thereof.

EXAMPLE 1

The compound of 4.3 g as described in the Compound Example 5 is added in mixed solution of 4.3 ml of dibutylphthalate and 20 ml of ethyl acetate, and the mixture is then dissolved completely at 40° C. to be used as a precursor of color developing agent. Said dissolved mixture is mixed with 5 ml of 10% solution of Alkanol B (alkylnaphthalene sulfonate, made by Du Pont) and 200 ml of 5% solution of gelatin and is then emulsifiedly dispersed by making use of a colloidal mill to prepare dispersed solution of precursor of color developing agent, and further water, coating assistant and hardening agent are added therein to make 330 ml. Thus obtained solution is coated onto a resin coated paper support. The coated amount of said precursor used in this case is 4.0 mg per 100 $cm^2$ of coated area. The dissolution of 2-[2-(2,4-di-t-pentylphenoxy)butaneamide]-4,6-dichloro-5-methylphenyl is made in dibutylphthalate and protective dispersion thereof is made in gelatin solution, and then the product therefrom is mingled with red-sensitive silver chlorobromide to be coated onto said coated layer of the support to serve as coupler and it is dried up. The coated amount of said coupler used in this case is 3.0 mg per 100 $cm^2$ of coated area, and the amount of silver to be used is 2.1 mg.

Further, a protective layer is made on the said layer by coating with 3% solution of gelatin. Coating assistant and hardening agent are added in each layer. Thus obtained sample is designated as Sample 1.

Such another sample is designated as Sample 2 that is obtained by making use of the same process as used in Sample 1, except that the precursor of color developing agent is changed for 3.6 g of Compound (A) being formularized by the structural formula shown below.

In much the same way, the further sample is designated as Sample 3 that is obtained by making use of 4,8 g of Compound (B) as precursor of color developing agent.

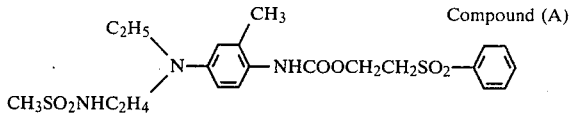

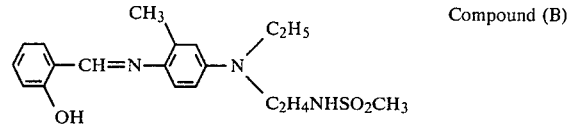

(For the purpose of comparison, Compounds (A) and (B) are used, of which the former is described in the Japanese Patent Publication Open to Public Inspection No. 135628/1978 and the latter in the U.S. Pat. No. 3,342,599)

Each of Samples 1, 2 and 3 is exposed to white light through a step-wedge and is processed as follows:

| | | |
|---|---|---|
| Process: | | |
| Activating developing | at 50° C. | 1' |
| Bleaching & fixing | " | 1' 30" |
| Washing | " | 2' |
| Stabilizing | " | 1' |
| Activating solution | | |
| Benzyl alcohol | | 14 ml |
| Sodium sulfite | | 2 g |
| Potassium bromide | | 0.5 g |
| Sodium carbonate (monohydrate) | | 30 g |
| Add water to make | | 1 ltr. |
| Bleaching & fixing solution | | |
| Ammonium thiosulfate (70%) | | 150 ml |
| Sodium sulfite | | 5 g |
| Na[Fe(III) (EDTA)] | | 40 g |
| EDTA | | 4 g |
| Add water to make | | 1 ltr. |
| (EDTA: ethylenediamine tetraacetic acid) | | |
| Stabilizing solution | | |
| Glacial acetic acid | | 10 ml |
| Sodium acetate | | 5 g |
| Formalin (37%) | | 5 ml |
| Add water to make | | 1 ltr. |

The obtained results is shown in Table 1.

Each of Samples 1, 2 and 3 is preserved for two days in the atomosphere at 50° C. and then an incubation is made on each of them, and thereafter the aforementioned exposure to light and processing are made on each of them.

TABLE 1

| Sample No. | Compound | Fog | Relative* sensitivity | Max. density |
|---|---|---|---|---|
| Sample 1 (The invention) | Compound 5 | 0.05 | 100 | 2.20 |
| Sample 2 (Other than the invention) | Compound A | 0.05 | 70 | 1.18 |
| Sample 3 (Other than the invention) | Compound B | 0.39 | 55 | 1.87 |
| Aftet incubation | | | | |
| Sample 1 (The invention) | Compound 5 | 0.06 | 95 | 2.19 |
| Sample 2 (Other than the invention) | Compound A | 0.07 | 65 | 1.03 |
| Sample 3 (Other than | Compound B | 0.53 | 45 | 1.21 |

TABLE 1-continued the invention)

Note

*Relative sensitivity means the relatively converted sensitivity ratio of each sample to the sensitivity of Sample 1 (without having done a torture testing) which is regarded as 100.

It is believable that Compounds (A) and (B) for comparison use are the most superior among the publicly known technical products containing color developing agent, but Compound (A) has a low sensitivity and a fairly low maximum color density, though it has only a few fogs. It is noticed such defects of Compound (B) as that it is colored in yellow in itself and processed sensitive material causes dense yellow fog thereon unless precursor is decomposed by alkali. It is also proved by the torture testing that the ageing stability of Sample 3 containing Compound (B) is not so good.

In constrast with the above, Sample 1 containing the compound of the invention has sparse fog, high sensitivity and extremely superior color density, and the problem of poor ageing stability is entirely solved therein, that is the worst defect of color developing agent containing type photographic material.

EXAMPLE 2

2-(1-benzyl-2,4-dioxyimidazolidine-3-yl)-2-pivalyl-2'-chloro-5'-[4-(2,4-di-t-pentylphenoxy)butaneamide] acetanilide is dissolved in dibutylphthalate and the solution prepared thereby is protectively dispersed in gelatin solution and then mixed with silver chlorobromide emulsion, and thereafter the mixture serving as coupler, is coated on a resin-coated paper support. The coated amounts of said coupler and silver used in this case are 8.3 mg and 3.5 mg per 100 $cm^2$ of coared area, respectively. Both dioctylhydroquinone and the compound of Compound Example 6 are dissolved in tricresyl phosphate and the solution prepared thereby is protectively dispersed in gelatin solution, and then is coated on the above coated layer. The coated amounts of said dioctylhydroquinone and Compound 6 used in this case are 0.9 mg and 10.0 mg per 100 $cm^2$ of coated area, respectively.

Further, 3-{2-chloro-5-[1-(octadesyl)succinimide]anilino}-1-(2,4,6-trichlorophenyl)-5-pyrazolone is dissolved in dibutylphthalate, and the solution prepared thereby is protectively dispersed in gelatin solution, and is then mixed with greensensitive silver chlorobromide emulsion, and the mixture thereof serving as coupler, is coated on the above coated layer, and it is dried up. The amounts of the coupler and silver used in this case are 4.3 mg and 3.9 mg per 100 $cm^2$ of coated area, respectively.

Further, dioctylhydroquinone and Compound 6 are dissolved in tricresylphosphate, and the solution prepared thereby is protectively dispersed in gelatin solution, and then is coated on the above layer. The coated amounts of dioctylhydroquinone and Compound 6 used in this case are 0.5 mg and 67.0 mg per 100 $cm^2$ of coated area, respectively.

Further, 2-[2-(2,4-di-t-pentylphenoxy)butaneamide]-4,6-dichloro-5-methylphenol is dissolved in dibutylphthalate, and the solution prepared thereby is protectively dispersed in gelatin solution, and is then mixed with red-sensitive silver chlorobromide emulsion, and the mixture thereof serving as coupler is coated on the above coated layer, and it is dried up. The coated amounts of said coupler and silver used to this case are 3.0 mg and 2.1 mg per 100 $cm^2$ of coated area, respectively.

Furthermore, Compound 6 is dissolved in tricresylphosphate and the solution prepared thereby is protectively dispersed in gelatin solution, and is then coated on the above coated layer. The coated amount of Compound 6 used in this case is 3.5 mg per 100 $cm^2$ of coated area.

Thus obtained sample is hereby designated as Sample 4.

The sample obtained by making use of Compound 11 instead of Compound 6 is now designated as Sample 5.

In the same way, Samples 6, 7 and 8 are obtained by making use of Compounds 12, 14 and 15, respectively.

In addition to the above, Samples 9 and 10 are obtained by making use of Compounds (A) and (B) those of which are used in Example 1, and these samples are designated as Comparison Samples. However, the coated amount of each compounds are changed so as to have the same mol value with that of Compound 5.

Samples 4–10 is processed after being exposed to white light, just in the same process with that of Example 1.

The results obtained thereby are shown in Table 2.

TABLE 2

| | | (Note) Fog | | | (Note 1) Relative sensitivity | | | Maximum density | | |
|---|---|---|---|---|---|---|---|---|---|---|
| Sample No. | Compound | Y | M | C | Y | M | C | Y | M | C |
| Sample 4 (The invention) | Compound (6) | 0.05 | 0.05 | 0.05 | 100 | 108 | 106 | 2.15 | 2.27 | 2.36 |
| Sample 5 (The invention) | Compound (11) | 0.06 | 0.07 | 0.06 | 98 | 102 | 103 | 2.24 | 2.28 | 2.20 |
| Sample 6 (The invention) | Compound (12) | 0.05 | 0.07 | 0.06 | 95 | 99 | 98 | 2.00 | 2.25 | 2.24 |
| Sample 7 (The invention) | Compound (14) | 0.05 | 0.06 | 0.06 | 96 | 107 | 101 | 2.13 | 2.19 | 2.33 |
| Sample 8 (The invention) | Compound (15) | 0.06 | 0.05 | 0.05 | 95 | 104 | 102 | 2.00 | 2.20 | 2.25 |
| Sample 9 (Other than the invention | Compound (A) | 0.09 | 0.09 | 0.06 | 68 | 84 | 66 | 0.91 | 1.59 | 0.81 |
| Sample 10 | Compound | | | | (Note | | | | | |

TABLE 2-continued

| Sample No. | Compound | (Note) Fog Y | M | C | (Note 1) Relative sensitivity Y | M | C | Maximum density Y | M | C |
|---|---|---|---|---|---|---|---|---|---|---|
| (Other than the invention | (B) | 1.98 | 0.50 | 0.29 | 2) — | — | 48 | 2.02 | 1.58 | 1.79 |
| | | | After Incubation | | | | | | | |
| Sample 4 (The invention) | Compound (6) | 0.07 | 0.08 | 0.06 | 93 | 98 | 96 | 2.10 | 2.19 | 2.23 |
| Sample 5 (The invention) | Compound (11) | 0.08 | 0.08 | 0.07 | 93 | 97 | 94 | 2.20 | 2.27 | 2.18 |
| Sample 6 (The invention) | Compound (12) | 0.07 | 0.08 | 0.07 | 96 | 100 | 99 | 2.18 | 2.23 | 2.21 |
| Sample 7 (The invention) | Compound (14) | 0.07 | 0.08 | 0.06 | 91 | 97 | 95 | 2.10 | 2.16 | 2.30 |
| Sample 8 (The invention) | Compound (15) | 0.08 | 0.07 | 0.07 | 96 | 100 | 99 | 1.98 | 2.18 | 2.22 |
| Sample 9 (Other than the invention | Compound (A) | 0.13 | 0.12 | 0.09 | 61 | 77 | 61 | 0.83 | 1.39 | 0.74 |
| Sample 10 (Other than the invention | Compound (B) | 2.03 | 0.68 | 0.34 | — | — | 40 | 2.03 | 1.01 | 1.03 |

(Note 1) Relative sensitivity means the relatively converted sensitivity ratio of each sample to the yellow sensitivity of Sample 4 (without having done an incubation testing) which is regarded as 100.
(Note 2) The straight line, —, in the tables shows the fact that the fog density is so high that the measuring can not be made.

From the Table 2, it is apparent that the Comparison Sample 9 is inferior in sensitivity and maximum density, particularly in those of yellow and cyan to the extreme degree, though it has low fog densities. And for Comparison Sample 10, Compound (B) itself is colored in yellow and remains undecomposed by alkali in sensitive material, therefore yellow fogs in said sensitive material is extremely high.

In contrast with the above, Samples 4, 5, 6, 7 and 8 containing the compounds according to the present invention have low fog densities and extremely superior sensitivity and maximum density, and it can be evident from the results of incubation test that the increase of fog, decrease of sensitivity and lowering of maximum density of these samples of the invention are smaller than those of Comparison Samples.

EXAMPLE 3

In order to prepare coupler for black dye forming use, N-octadesyl-m-aminophenol of 10 g is added in a mixture of 10 ml of tricresylphosphate and 30 ml of ethyl acetate, and the solution prepared thereby is completed dissolved at 50° C. This solution is mixed with 5 ml of 10% Alkanol B solution and 200 ml of 5% gelatin solution, and this mixture is emulsified by making use of colloid mill, and thus coupler dispersion is prepared. This coupler dispersion is added in 500 g of silver iodobromide emulsion for radiographic use (which contains 5 mol% of silver iodobromide) and the added emulsion is coated on one side surface of polyester film base so that silver amount thereon can be about 40 mg per 100 $cm^2$ of said coated area.

Compound 5 is dissolved in tricresyl phosphate and the solution is protectively dispersed in gelatin solution, and thereafter the dispersion is coated on the above mentioned layer. The amount of Compound 5 used in this case is 20 mg per 100 $cm^2$ of said coated area. (Sample 11).

On the other hand, for the purpose of comparison, simple gelatin solution not containing Compound 5 is coated on the sample having been coated with silver iodobromide for radiographic containing said coupler for black dye forming. (Sample 12).

Sample 11 is a radiographic material containing precursor of color developing agent of the invention and couplers for black dye forming, and Sample 5 is a radiographic material containing coupler for black dye forming alone.

Sample 11 is exposed to light through the wedge and then developed in the alkaline activator, whose composition is shown below, at 20° C. for 5 minutes, and in succession the usual fixing and washing are made.

| | |
|---|---|
| Sodium sulfite anhydrous | 10 g |
| Sodium carbonate monohydrate | 30 g |
| Potassium bromide | 0.5 g |
| Add water to make | 1 l |

On the other hand, Sample 12 which was exposed to light in the same way as above is developed in the developer whose composition is shown below at 20° C. for 5 minutes, and in succession the usual fixing and washing are made.

| | |
|---|---|
| 4-amino-3-methyl-N,N-diethyl-anilinehydrochloride | 2 g |
| Sodium sulfite anhydrous | 10 g |
| Sodium carbonate monohydrate | 30 g |
| Potassium bromide | 0.5 g |

-continued

| | |
|---|---|
| Add water to make | 1 l |

As the results of the above processing, Samples 11 and 12 come out both blue-black dye images and silver images, and Sample 11 displays the equivalent photographic performance in all aspects of fog, sensitivity and maximum density in comparison with those of the control sample 12.

Alkaline activator which is used for processing Sample 11 and the developer which is used for processing Sample 12, each of which is poured in a beaker having a capacity of one liter and is allowed to stand without a cover on for ten days at room temperature, and then evaporated water is replenished to make one liter, and again Samples 11 and 12 are processed separately. Even when Sample 11 was processed after alkaline activator had been allowed to stand, its photographic performance was not lowered, but when Sample 12 was processed after the developer had been allowed to stand, its performance was considerably lowered, particularly fogs were increased remarkably thereon.

As described above, the preservability after processing of the photographic material of the invention containing precursor of color developing agent is remarkably improved because it can be developed with alkaline activator.

EXAMPLE 4

Compound of Compound Example 18 (black and white developing agent precursor) and compound of Compound Example 24 (developing inhibitant precursor) are dissolved in methanol and thus obtained solution is added in solver iodobromide emulsion for ordinary black and white negative film use (containing 5% mol silver iodide) and thus obtained emulsion is coated into triacetate film base so that the coated amounts of Compound 18, Compound 24 and silver can be 40 mg, 2.0 mg and 25 mg per 100 $cm^2$ of the coated area, respectively. (Sample 13)

Sample 13 is exposed to light through a wedge ordinarily and developed in 2% solution of sodium carbonate monohydrate for two minutes at 30° C., and then stopping, fixing and washing are made in an ordinary process. Thus processed Sample 13 has low fog densities and superior sensitivity and maximum density.

As described above, Sample 13 can be developed with very simple alkaline activator containing only sodium carbonate and can obtain a superior photographic performance, because it contains both black and white developing agent precursor of the invention and developing inhibitant precursor thereof.

EXAMPLE 5

Silver iodobromide emulsion for ordinary black and white negative film use (containing 5 mol% silver iodide) is coated on a triacetate base so taht the coated amount of silver can be 40 mg per 100 $cm^2$ of the coated area. Compound Example 20 is dissolved in methanol and then mixed with gelatin solution, and thus obtained mixture is coated onto said coated layer. The coated amount of Compound 20 is 3.3 mg per 100 $cm^2$ of the coated area. (Sample 14).

For the purpose of comparison, N,N,N',N'-tetramethyl-p-phenylenediamine (TMPD) 2 hydrochloride, instead of Compound 20, is dissolved in gelatin solution and thus obtained solution is coated. The coated amount of TMPD 2 hydrochloride is 1.0 mg per 100 $cm^2$ of the coated area. (Sample 15)

Further, a sample not containing Compound 20 and TMPD 2 hydrochloride, but having been coated with only gelatin on said emulsion layer is prepared. (Sample 16)

Each of Samples 14, 15 and 16 is exposed to light through a wedge ordinarily and developed in a developer having the following composition for one minute at 30° C., and the initial developability is examined, and after development is completed ordinary fixing and washing are made.

| Composition of the developer: | |
|---|---|
| Metol | 2.5 g |
| Hydroquinone | 2.5 g |
| Sodium sulfite anhydrous | 30 g |
| Sodium carbonate monohydrate | 10 g |
| Potassium bromide | 0.5 g |
| Add water to make | 1 l |

And, each sample is preserved for 24 hours under the conditions at the temperature of 50° C. and humidity of 80% and incubation test is tried.

The results obtained therefrom are shown in Table 3.

TABLE 3

| Sample No. | Compound | Fog | (Note) Relative sensitivity | Max. density |
|---|---|---|---|---|
| Sample 14 (The invention) | Compound (20) | 0.05 | 135 | 2.0 |
| Sample 15 (Other than the invention) | TMPD . 2HCl | 0.05 | 80 | 1.6 |
| Sample 16 (Other than the invention) | Nil | 0.05 | 100 | 1.6 |
| | After Incubation | | | |
| Sample 14 (The invention) | Compound (20) | 0.06 | 131 | 1.9 |
| Sample 15 (Other than the invention | TMPD . 2HCl | 0.05 | 63 | 0.8 |
| Sample 16 (Other than the invention | Nil | 0.07 | 98 | 1.5 |

[Note:
Relative sensitivity means the relatively converted sensitivity ratio of each sample to the sensitivity of Sample 16 (without having done a torture testing) which is regarded as 100.]

From Table 3, it is seen that Sample 15 brings great desensitization and ageing instability on itself, and contrastively it is proved that Sample 14 containing Compound 20 of the invention has remarkably seperior initial developability and considerably better ageing stability in comparison with Comparison Examples 15 and 16.

Therefore, when Compound 20 of the invention is included in a photographic material, said material has the advantages of that the development is greatly accelerated and also the ageing stability thereof is not affected.

What is claimed is:

1. A photographic material containing silver halide in at least one layer of structural layers coated on a support wherein at least one of the structural layers contains a compound represented by a following formula:

$$[D]^{+m} \cdot \left[ R^1-O-\overset{\overset{O}{\|}}{\underset{\underset{O}{|}}{P}}-OR^2 \right]^{-}_{m}$$

wherein D represents a nitrogen-containing organic base or a compound containing quaternary nitrogen atom, and $R^1$ and $R^2$ individually represent a hydrogen atom, a substituted or non-substituted alkyl group, alkenyl group, cycloalkyl group, phenyl group, or hetero ring group; or $R^1$ and $R^2$ may combine to form a ring, m is an integer from 1 to 5, and $R^1$ and $R^2$ are not both hydrogen at the same time.

2. The photographic material according to claim 1 in which one of $R^1$ and $R^2$ represents an aryl group.

3. The photographic material according to claim 2 in which $R^1$ and $R^2$ each represent an aryl group.

4. The photographic material according to claim 2 or 3 in which the aryl group is a chlorophenyl or methylphenyl group.

5. The photographic material according to claim 1 in which D represents a compound having a following formula:

$$R-NH_2,\ R-NH-R_3,\ RR_3R_4N \text{ or } RR_3R_4R_5N^+$$

wherein R, $R_3$, $R_4$ and $R_5$ individually represent a hydroxyl, alkyl, alkenyl, cycloalkyl, aryl, acyl, amino, carbamoyl, sulfonyl or 5 or 6 membered and a nitrogen, oxygen or sulfur atom containing heterocyclic group.

* * * * *